US011930894B1

(12) United States Patent
Gao

(10) Patent No.: US 11,930,894 B1
(45) Date of Patent: Mar. 19, 2024

(54) PLUGGABLE CONNECTING BUCKLE

(71) Applicant: Foshan Tuorun Precision Hardware Technology Co., Ltd, Guangdong (CN)

(72) Inventor: Maoyang Gao, Guangdong (CN)

(73) Assignee: Foshan Tuorun Precision Hardware Technology Co., Ltd, Foshan (CN)

( * ) Notice: Subject to any disclaimer, the term of this patent is extended or adjusted under 35 U.S.C. 154(b) by 0 days.

(21) Appl. No.: 18/110,378

(22) Filed: Feb. 16, 2023

(30) Foreign Application Priority Data

Oct. 25, 2022 (CN) ..... 202222848462.1

(51) Int. Cl.
*A44B 11/26* (2006.01)
*A44B 11/25* (2006.01)

(52) U.S. Cl.
CPC ..... *A44B 11/266* (2013.01); *A44B 11/2592* (2013.01)

(58) Field of Classification Search
CPC ..... A44B 11/266; A44B 11/2592
See application file for complete search history.

(56) References Cited

U.S. PATENT DOCUMENTS 6,965,231 B1 * 11/2005 Cinoglu ..... A61B 5/055 324/307
7,350,277 B1 * 4/2008 Canfield ..... A44B 11/253 24/637
9,578,929 B2 * 2/2017 Hung ..... A44B 11/2511
10,849,391 B2 * 12/2020 Templeton ..... A44B 11/2561
2006/0048350 A1 * 3/2006 Coulombe ..... A44B 11/253 24/634

FOREIGN PATENT DOCUMENTS

CN 216932112 U 7/2022

* cited by examiner

*Primary Examiner* — Robert Sandy

(57) ABSTRACT

The present application discloses a pluggable connecting buckle, including a male buckle and a female buckle. A first connecting rod is arranged on one end of the male buckle, and a decorative plate and a buckling rib are arranged on an other end. A buckling block is arranged on the buckling rib, and a corresponding engagement groove is arranged on the buckling rib. A second connecting rod and an accommodating cavity are respectively arranged on two ends of the female buckle. Two engagement assemblies are respectively arranged on two sides of the accommodating cavity. A limiting plate is arranged on the engagement assembly which includes a turning plate. An inclined engagement surface is arranged on the engagement groove, and an inverted hook plane is arranged on the turning end of the turning plate. The pluggable connecting buckle has a good anti-loosening effect, a long service life, and good user experience.

10 Claims, 7 Drawing Sheets

（Prior Art）

PLUGGABLE CONNECTING BUCKLE

CROSS REFERENCE TO RELATED APPLICATIONS

The present application claims the benefit of Chinese Patent Application No. 202222848462.1 filed on Oct. 25, 2022, the contents of which are incorporated herein by reference in their entirety.

TECHNICAL FIELD

The present application relates to the technical field of connecting buckles, and in particular, to a pluggable connecting buckle.

BACKGROUND

As a connecting accessory for a product such as a belt and a pet rope, a connecting buckle mainly functions to connect two ends of the belt or the pet rope together, and also plays a decorative role. A buckle is disclosed in the Chinese Patent Application No. CN216932112U. The technical solution is a buckle. As shown in FIG. 1, the buckle includes a connecting member a1 and a fixing member a2. An insertion portion is arranged on an end of the connecting member a1, a V-shaped insertion bump all is arranged on an end of the insertion portion, and an engagement groove a12 is arranged on two sides of the insertion portion. A fixing groove engaged with the insertion portion is arranged on an end of the fixing member a2, and a blocking rib a21 engaged with the insertion bump all is arranged on an end of the fixing groove. Two engagement devices a22 are arranged in the fixing groove. Each of the engagement devices a22 includes a fixing shaft a221. The fixing shaft a221 is hinged with a turning block. A turning portion a222 of the turning block is arranged on an outer side of the fixing groove, and a resisting portion a223 configured to abut against the engagement groove a12 is arranged on an other end of the turning block. An inclined surface that does not hinder rotation of the turning block is arranged on an end of the engagement groove a12 close to the insertion bump all, and a return spring a224 is arranged on the resisting portion a223.

The advantages are a simple structure and convenient and fast insertion and unlocking. The disadvantages are: 1. For example, the buckle is used on the pet rope. When the buckle is engaged, the buckle is always in motion as a pet runs or jumps. Due to a reactive force of the return spring a224 on the resisting portion a223, the resisting portion a223 repeatedly shocks with the movement of the pet, so that a side edge a23 of the fixing groove and the turning portion a222 repeatedly collide with each other. An arcuate surface of the resisting portion a223 often rubs against an inclined surface of the engagement groove a12, and the turning portion a222 and the resisting portion a223 gradually wear out after a period of use. Therefore, an engagement gap between the connecting member a1 and the fixing member a2 gradually increases during the engagement, and the buckle may be loose after the engagement, which increases the frequency of abnormal sound and affects user experience. 2. Due to the inclined contact between the return spring a224 and the fixing groove, forces withstood by the return spring a224 are not uniform, and the return spring a224 is easy to break, cause the buckle not to be used any more. 3. The turning portion a222 is in the shape of an acute angle, which results in a poor turning experience for a user.

Therefore, a pluggable connecting buckle is provided.

SUMMARY

The present application is intended to provide a pluggable connecting buckle, which has the advantages of a good anti-loosening effect, a long service life, and good user experience.

In order to achieve the above objective, the present application adopts the following technical solution.

A pluggable connecting buckle includes a male buckle and a female buckle. A first connecting rod is arranged on one end of the male buckle, and a decorative plate and a buckling rib protruding from an inner side of the decorative plate are arranged on an other end of the male buckle. A buckling block is arranged on an end of the buckling rib away from the first connecting rod, and a corresponding engagement groove is arranged on each of two sides of the buckling rib. A second connecting rod is arranged on one end of the female buckle, and an accommodating cavity with an outer open end is arranged on an other end of the female buckle. A blocking block engaged with the buckling block is arranged on an inner end of the accommodating cavity. Two corresponding engagement assemblies are respectively arranged on two sides of the accommodating cavity. A limiting plate is arranged on an outer side of each of the engagement assemblies. Each engagement assembly includes a riveting shaft perpendicular to a buckling direction, a turning plate rotatably connected to the riveting shaft, and a spring arranged on the turning plate. One end of the turning plate protruding from the limiting plate is a turning end, and an other end of the turning plate configured to abut against the engagement groove is an engagement end. An inclined engagement surface that does not hinder rotation of the engagement end is arranged on a side of the engagement groove close to the buckling block. The spring is arranged on the engagement end. A spring limiting block corresponding to the spring is arranged on the inner end of the accommodating cavity, a notch engaged with the turning end is arranged on the limiting plate, and an inverted hook plane corresponding to the limiting plate is arranged on the turning end.

Further, a planar engagement end surface is arranged on an end of the engagement end, and the inclined engagement surface is tangent to a movement trajectory of the engagement end surface when the male buckle and the female buckle are in a buckled state.

Further, an anti-loosening protrusion is arranged on the engagement end surface, and an anti-loosening recess corresponding to the anti-loosening protrusion is arranged on the inclined engagement surface.

Further, a limiting end surface of the spring limiting block is perpendicular to a central axis of the spring when the male buckle and the female buckle are in a buckled state.

Further, the turning end is semicircular, and anti-slip grooves are uniformly arranged on the turning end.

Further, a protrusion corresponding to the turning plate is arranged at the notch.

Further, a spring fixing base is arranged on a side of the engagement end, and a spring engagement post is arranged on a side of the spring fixing base.

Further, a fastening groove is arranged between the buckling rib and the decorative plate, and a planar fastening plate engaged with the fastening groove is arranged on a side of the accommodating cavity close to the decorative plate.

Further, a fastening rib parallel to the buckling direction is arranged on an outer side of the planar fastening plate.

Further, an end of the male buckle is in the shape of a square frame, a chute is recessed on each of two corresponding inner side surfaces, and two ends of the first connecting rod are engaged with the chutes.

The present application includes a male buckle and a female buckle. A first connecting rod is arranged on one end of the male buckle, and a decorative plate and a buckling rib are arranged on an other end of the male buckle. A buckling block is arranged on an end of the buckling rib, and a corresponding engagement groove is arranged on each of two sides of the buckling rib. A second connecting rod is arranged on one end of the female buckle, and an accommodating cavity with an outer open end is arranged on an other end of the female buckle. Two corresponding engagement assemblies are respectively arranged on two sides of the accommodating cavity, and a limiting plate is arranged on an outer side of each of the engagement assemblies. Each engagement assembly includes a riveting shaft, a turning plate, and a spring. One end of the turning plate protruding from the limiting plate is a turning end, and an other end of the turning plate configured to abut against the engagement groove is an engagement end. An inclined engagement surface that does not hinder rotation of the engagement end is arranged on a side of the engagement groove close to the buckling block, and an inverted hook plane corresponding to the limiting plate is arranged on the turning end. The pluggable connecting buckle has the advantages of a good anti-loosening effect, a long service life, and good user experience.

DETAILED DESCRIPTION

Figure 1:
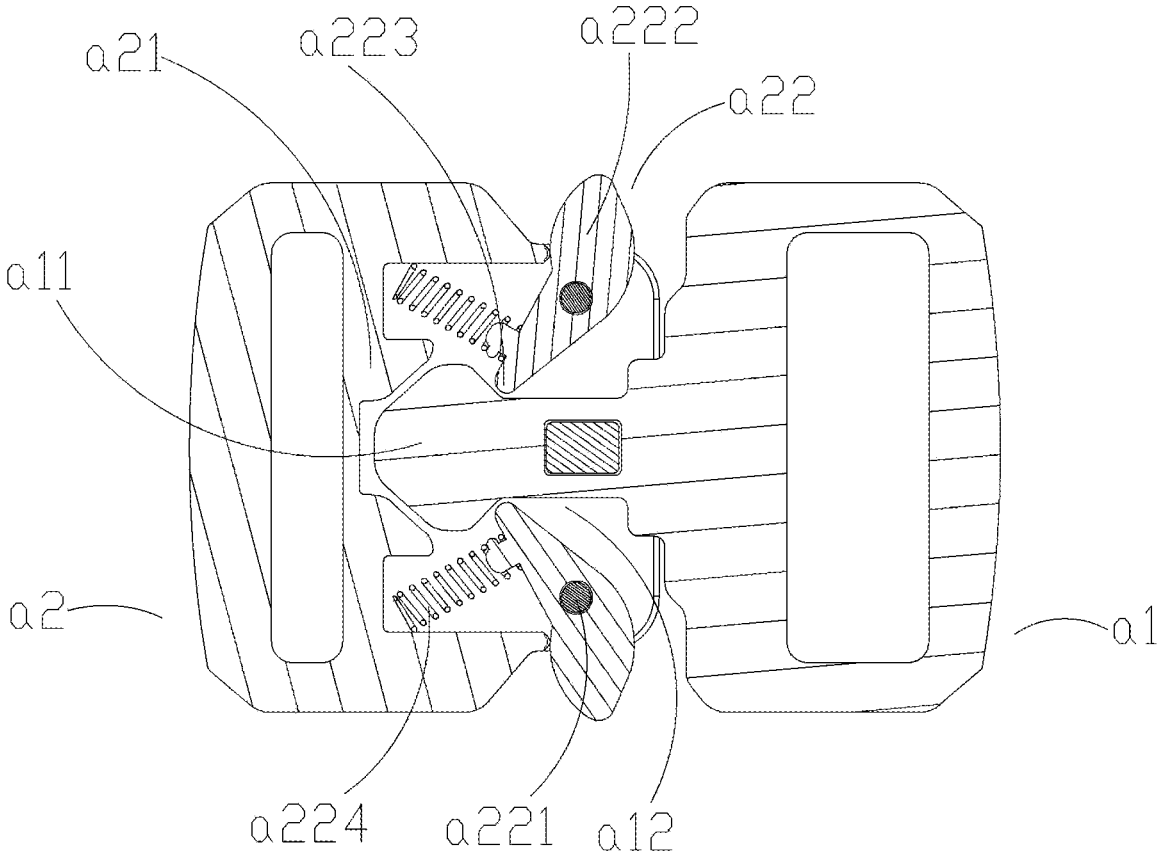
FIG. 1 is a front cross-sectional view of a buckle according to the Patent Application No. CN216932112U.
Figure 2:
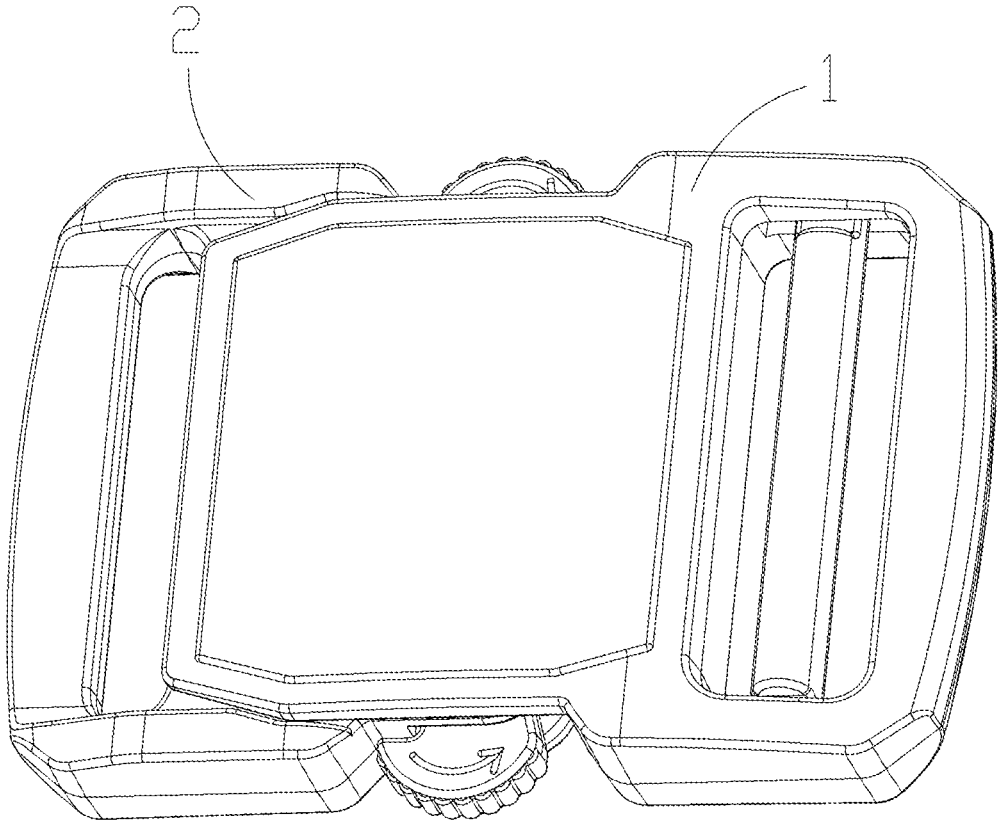
FIG. 2 is a perspective view of a pluggable connecting buckle according to the present application.
Figure 3:
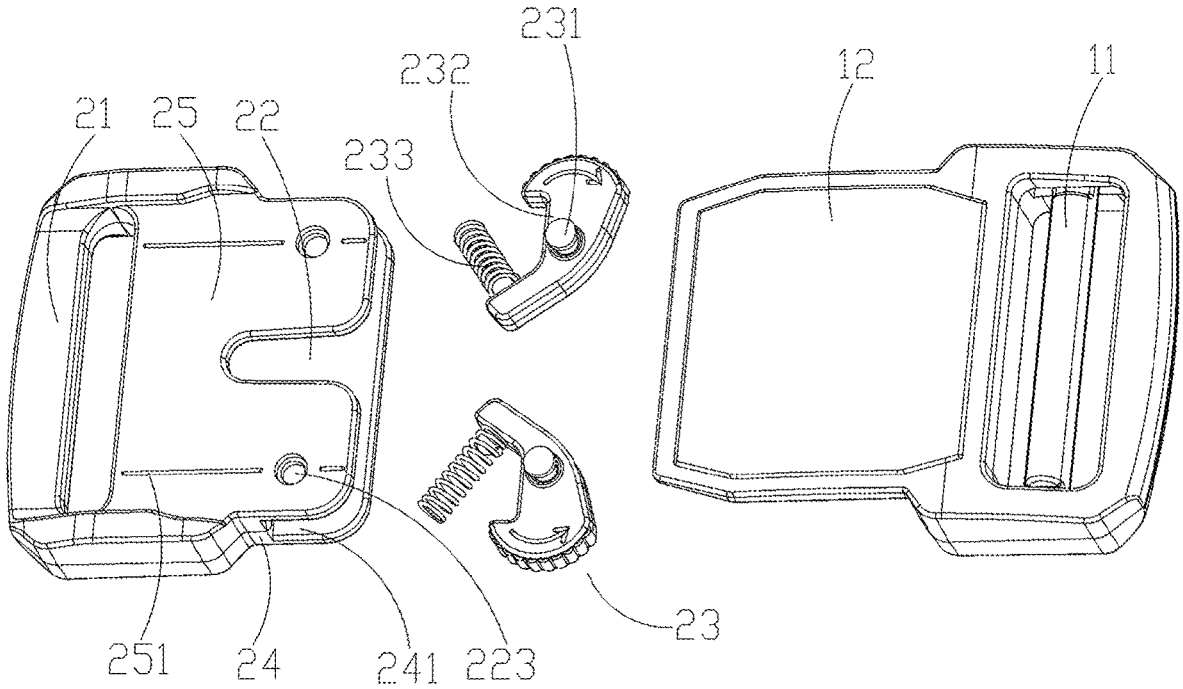
FIG. 3 is an exploded view of a pluggable connecting buckle according to the present application.
Figure 4:
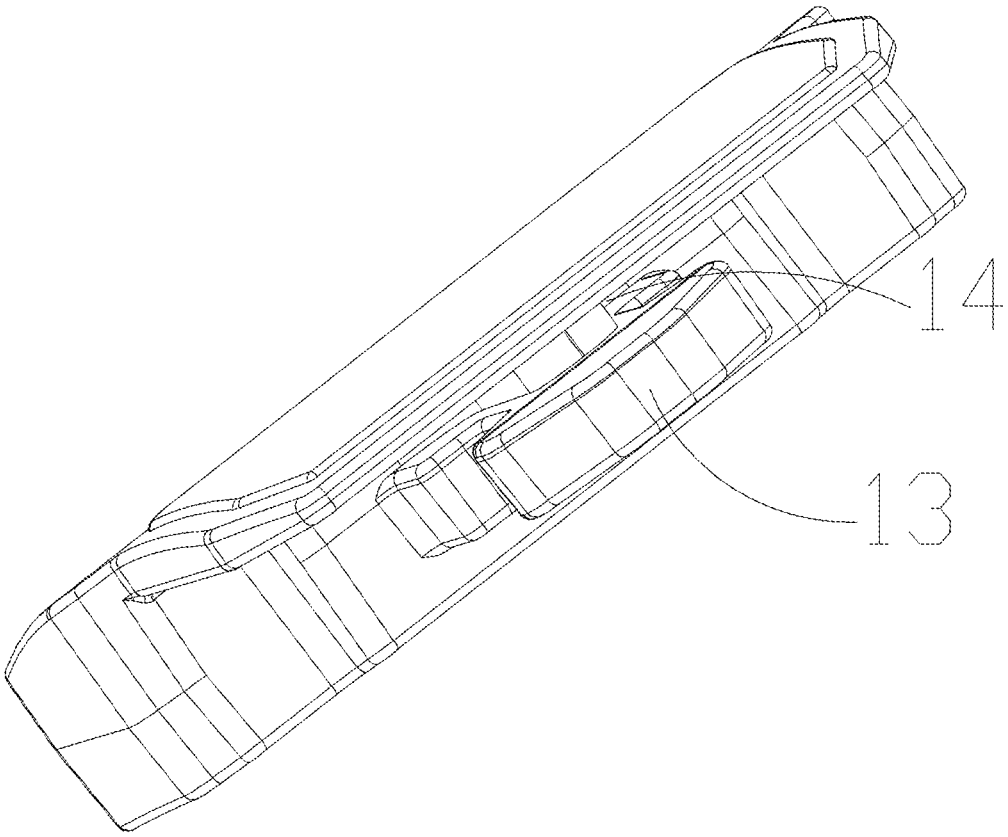
FIG. 4 is a perspective view of a male buckle in a pluggable connecting buckle according to the present application.
Figure 5:
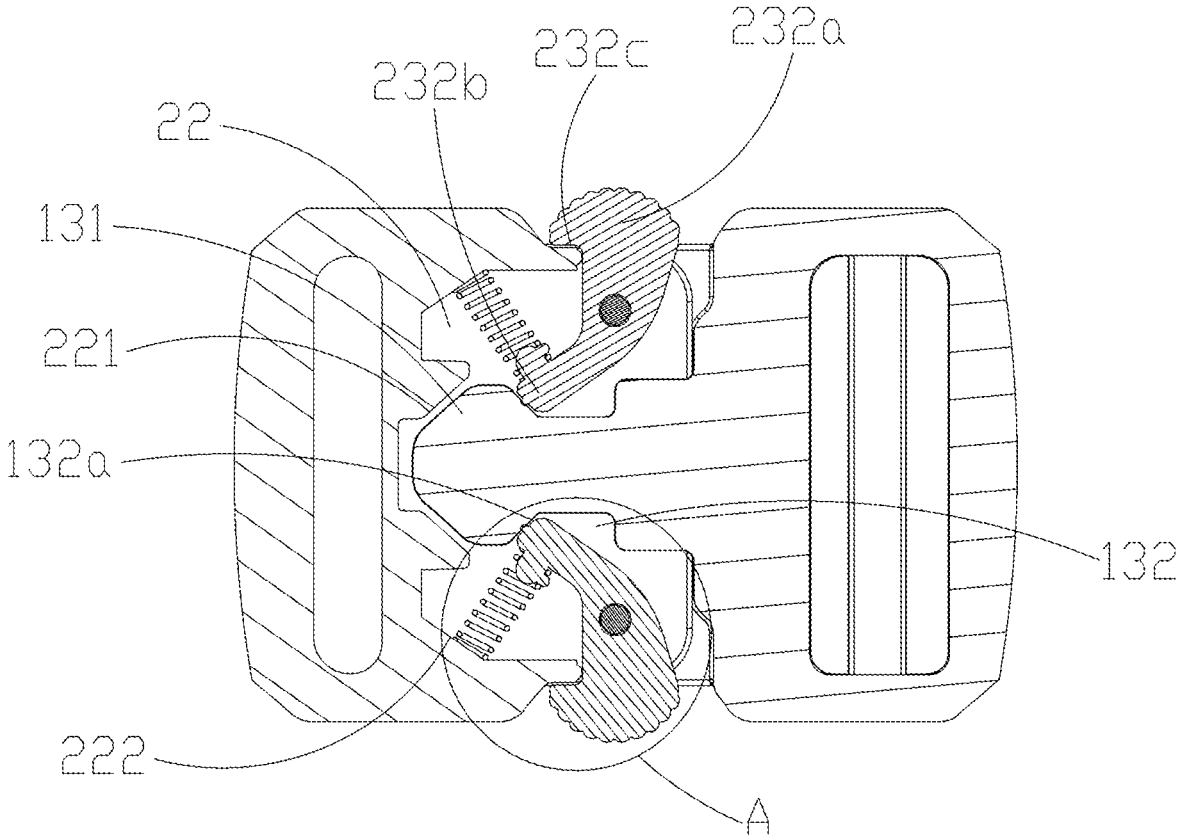
FIG. 5 is a front cross-sectional view of a pluggable connecting buckle according to the present application.
Figure 6:
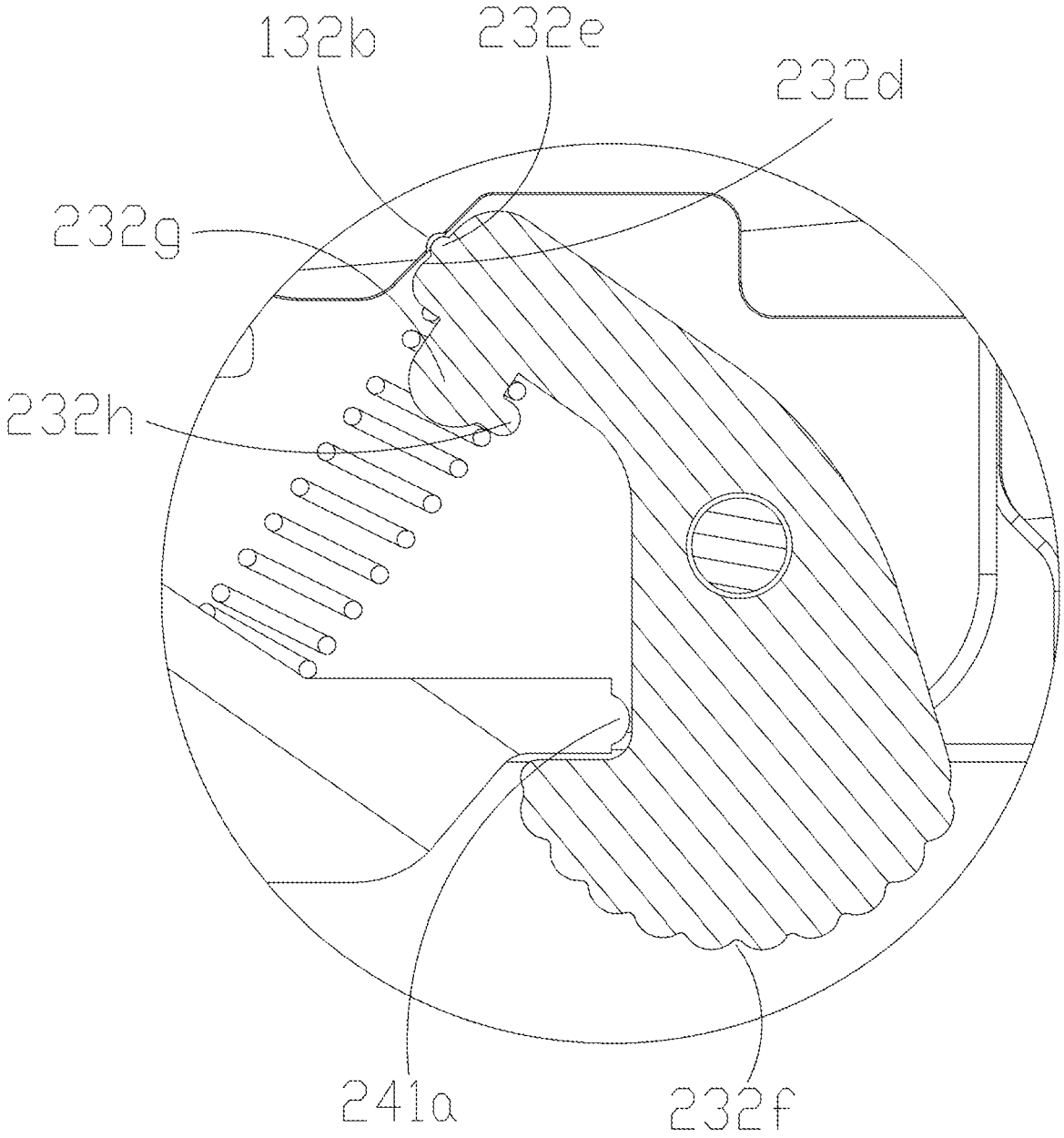
FIG. 6 is a partial schematic enlarged view of A in FIG. 5.
Figure 7:
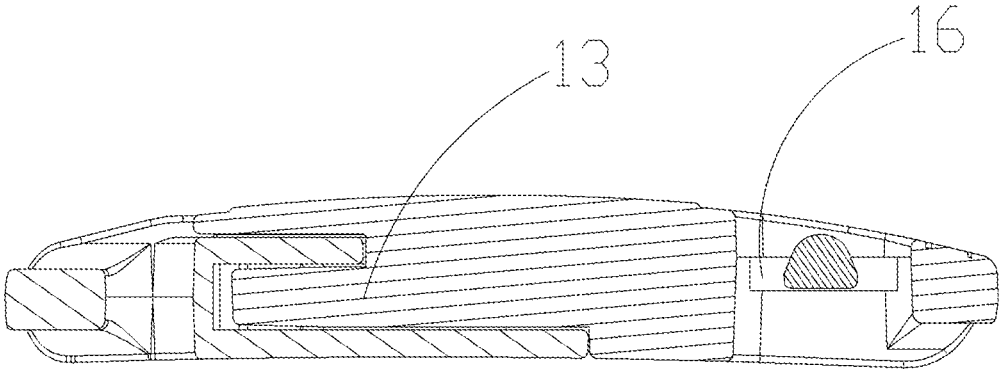
FIG. 7 is a bottom cross-sectional view of a pluggable connecting buckle according to the present application.

The present application provides a pluggable connecting buckle. In order to make the objectives, technical solutions, and effects of the present application clearer and explicit, the present application is further described in detail with reference to the accompanying drawings and by using embodiments. It should be understood that, the specific embodiments described herein are merely used for explaining the present application rather than limiting the present application.

A pluggable connecting buckle provided in the present application has structures shown in FIG. 2 to FIG. 7, which includes a male buckle 1 and a female buckle 2. A first connecting rod 11 is arranged on one end of the male buckle 1, and the first connecting rod 11 is configured to fix an end of a connecting belt. A decorative plate 12 and a buckling rib 13 protruding from an inner side of the decorative plate 12 are arranged on an other end of the male buckle 1. A buckling block 131 is arranged on an end of the buckling rib 13 away from the first connecting rod 11, and a corresponding engagement groove 132 is arranged on each of two sides of the buckling rib 13.

A second connecting rod 21 is arranged on one end of the female buckle 2, and the second connecting rod 21 is configured to fix an other end of the connecting belt. An accommodating cavity 22 with an outer open end is arranged on an other end of the female buckle 2. A blocking block 221 engaged with the buckling block 131 is arranged on an inner end of the accommodating cavity 22. Two corresponding engagement assemblies 23 are respectively arranged on two sides of the accommodating cavity 22. A limiting plate 24 is arranged on an outer side of each of the engagement assemblies 23. The engagement assembly 23 includes a riveting shaft 231 perpendicular to a buckling direction, a turning plate 232 rotatably connected to the riveting shaft 231, and a spring 233 arranged on the turning plate 232. One end of the turning plate 232 protruding from the limiting plate 24 is a turning end 232*a*, and an other end configured to abut against the engagement groove 132 is an engagement end 232*b*. An inclined engagement surface 132*a* that does not hinder rotation of the engagement end 232*b* is arranged on a side of the engagement groove 132 close to the buckling block 131. The spring 233 is arranged on the engagement end 232*b*. A spring limiting block 222 corresponding to the spring 233 is arranged on the inner end of the accommodating cavity 22. A notch 241 engaged with the turning end 232*a* is arranged on the limiting plate 24, and an inverted hook plane 232*c* corresponding to the limiting plate 24 is arranged on the turning end 232*a*.

During mounting of the engagement assembly 23, a riveting hole 223 engaged with the riveting shaft 231 is arranged on each of an inner side and an outer side of the accommodating cavity 22. The spring 233 is placed on the turning plate 232, and the turning plate 232 is placed in a corresponding position in the accommodating cavity 22. After the riveting shaft 231 extends through one riveting hole 223 and the turning plate 232, an end of the riveting shaft 231 is riveted with the other riveting hole 223, so that the engagement assembly 23 can be fixed in the accommodating cavity 22. In this case, the spring limiting block 222 causes the spring 233 to generate thrust to the engagement end 232*b*, and the inverted hook plane 232*c* corresponding to the limiting plate 24 causes the turning plate 232 to be limited. When the male buckle 1 and the female buckle 2 are buckled together, the buckling rib 13 moves toward the accommodating cavity 22, the buckling block 131 pushes the engagement end 232*b*, the spring 233 is compressed, and the turning plate 232 rotates, and the inverted hook plane 232*c* gradually moves away from the limiting plate 24. The buckling rib 13 further moves toward the accommodating cavity 22, so that the inclined engagement surface 132*a* reaches a position of the engagement end 232*b*. The engagement end 232*b* moves along the inclined engagement surface 132*a*, and a length of the spring 233 gradually increases. In addition, the turning plate 232 rotates reversely, the inverted hook plane 232*c* gradually moves closer to the limiting plate 24 until the inverted hook plane 232*c* coincides with the limiting plate 24, and the turning plate 232 returns to an initial position. When the buckling block 131 reaches the position of blocking block 221, the engagement end 232*b* abuts against the engagement groove 132 to prevent the buckling block 131 from being disengaged from the accommodating cavity 22, so that the male buckle 1 and the female buckle 2 are completely buckled together. When the male buckle 1 and the female buckle 2 need to be separated, the turning plate 232 is turned according to an arrow direction shown in FIG. 2 and FIG. 3, the spring 233 is compressed, and the engagement end 232*b* does not hinder the buckling block 131 from leaving the accommodating cavity 22. In this way, the male buckle 1 and the female buckle 2 can be unlocked and separated. With this structure, the user can conveniently and quickly complete the buckling or unbuckling of the male buckle 1 and the female buckle 2.

When the male buckle 1 and the female buckle 2 are buckled together, even if the whole connecting buckle is in a state of vibration for a long time, the inverted hook plane 232*c* is caused to constantly impact the limiting plate 24 due to elastic deformation of the spring 233. The impact between the inverted hook plane 232*c* and the limiting plate 24 is a plane-to-plane impact, stress distribution is uniform, and it is difficult to change the limiting position of the turning plate 232. Therefore, after the male buckle 1 and the female buckle 2 are buckled together, a gap between the male buckle 1 and the female buckle 2 will not become larger, which avoids a phenomenon that the gap between the connecting member a1 and the fixing member a2 becomes larger after the buckles are buckled together due to the turning block being easy to wear, causing the buckle to loose and producing abnormal sound during use in the patent with the Patent Application No. CN216932112U shown in FIG. 1. It can be seen that the connecting buckle in this embodiment has a good anti-loosening effect and brings the user good experience.

Specifically, a planar engagement end surface 232*d* is arranged on an end of the engagement end 232*b*, and the inclined engagement surface 132*a* is tangent to a movement trajectory of the engagement end surface 232*d* when the male buckle 1 and the female buckle 2 are in a buckled state. In this way, after the male buckle 1 and the female buckle 2 are buckled together, when the vibration of the whole connecting buckle causes friction between the inclined engagement surface 132*a* and the engagement end surface 232*d*, forces of the friction between the two surfaces are equal, which avoids excessive wear of the engagement end 232*b* and loosening of the connecting buckle. An anti-loosening protrusion 232*e* is arranged on the engagement end surface 232*d*, and an anti-loosening recess 132*b* corresponding to the anti-loosening protrusion 232*e* is arranged on the inclined engagement surface 132*a*. Since the vibration amplitude of the connecting buckle is not too large, the anti-loosening recess 132*b* causes the engagement end 232*b* to fully abut against the engagement groove 132, which avoids the friction caused by relative movement between the inclined engagement surface 132*a* and the engagement end surface 232*d*, and further ensures the good anti-loosening effect of the connecting buckle.

Specifically, a limiting end surface of the spring limiting block 222 is perpendicular to a central axis of the spring 233 when the male buckle 1 and the female buckle 2 are in a buckled state. In this way, the spring limiting block 222 applies a uniform reactive force to the spring 233, which avoids causing a non-standard failure of deformation of the spring 233, and even fracture due to an uneven force withstood by the spring 233 for a long time, thereby increasing the service life of the connecting buckle.

Specifically, the turning end 232*a* is semicircular, and anti-slip grooves 232*f* are uniformly arranged on the turning end. This shape avoids finger soreness caused by the turning end in the shape of an acute angle, so that the user has good experience when turning the turning plate 232.

Specifically, a protrusion 241*a* corresponding to the turning plate is arranged at the notch 241. A large area of surface treatment damage to the plane at the notch 241 and the turning plate 232 caused by the contact between the turning plate 232 and the plane at the notch 241 is avoided, thereby ensuring a good appearance of the connecting buckle.

Specifically, a spring fixing base 232*g* is arranged on a side of the engagement end 232*b*, and a spring engagement post 232*h* is arranged on a side of the spring fixing base 232*g*, so as to avoid the phenomenon that the engagement assembly 23 cannot be effectively engaged due to shifting of the spring 233 in the accommodating cavity 22, thereby ensuring stable buckling of the whole connecting buckle.

Specifically, a fastening groove 14 is arranged between the buckling rib 13 and the decorative plate 12, and a planar fastening plate 25 engaged with the fastening groove 14 is arranged on a side of the accommodating cavity 22 close to the decorative plate 12. An avoidance opening for avoiding a part of the buckling rib 13 connected to the decorative plate 12 is arranged on the planar fastening plate 25. The planar fastening plate 25 is engaged with the fastening groove 14, so that the gap in inner and outer directions is smaller after the male buckle 1 and female buckle 2 are buckled, which further reduces the phenomenon of loosening of the connecting buckle. A fastening rib 251 parallel to the buckling direction is arranged on an outer side of the planar fastening plate 25. Upon completion of manufacturing and formation and surface treatment of the male buckle 1 and the female buckle 2, it cannot be guaranteed that the contact surface between the planar fastening plate 25 and the fastening groove 14 is completely on a flat plane. Therefore, a certain assembly gap is to be remained between the planar fastening plate 25 and the fastening groove 14. If the assembly gap is too small, the male buckle 1 and the female buckle 2 are difficult to buckle together. If the assembly gap is too large, the male buckle 1 and the female buckle 2 are easy to loosen. A relatively small assembly gap is defined between a sum of thicknesses of the planar fastening plate 25 and the fastening rib 251 and a thickness of the fastening groove 14, which does not affect the buckling between the male buckle 1 and the female buckle 2, facilitates smooth buckling of the buckle, and can also ensure the anti-loosening effect of the whole connecting buckle.

Specifically, an end of the male buckle 1 is in the shape of a square frame. A chute 16 is recessed on each of two corresponding inner side surfaces of the square frame. Two ends of the first connecting rod 11 are engaged with the chutes 16 in an engagement manner. The first connecting rod 11 can slide in the chute 16 to change the length of the connecting belt using the connecting buckle, so that the connecting belt can freely adjust the length within a small range with movement of the user, thereby improving user experience.

Based on the above, the present application includes a male buckle 1 and a female buckle 2. A first connecting rod 11 is arranged on one end of the male buckle 1, and a decorative plate 12 and a buckling rib 13 are arranged on an other end. A buckling block 131 is arranged on an end of the buckling rib 13, and a corresponding engagement groove 132 is arranged on each of two sides of the buckling rib 13. A second connecting rod 21 is arranged on one end of the female buckle 2, and an accommodating cavity 22 with an outer open end is arranged on an other end. Two corresponding engagement assemblies 23 are respectively arranged on two sides of the accommodating cavity 22, and a limiting plate 24 is arranged on an outer side of each of the engagement assemblies 23. The engagement assembly 23 includes a riveting shaft 231, a turning plate 232, and a spring 233. One end of the turning plate 232 protruding from the limiting plate 24 is a turning end 232*a*, and an other end configured to abut against the engagement groove 132 is an engagement end 232*b*. An inclined engagement surface 132*a* that does not hinder rotation of the engagement end 232*b* is arranged on a side of the engagement groove 132 close to the buckling block 131, and an inverted hook plane 232*c* corresponding to the limiting plate 24 is arranged on the turning end 232*a*. The pluggable connecting buckle has the advantages that the wear of the turning plate 232 is avoided through the inverted hook plane 232*c* corresponding to the limiting plate 24, the planar engagement end surface 232*d*, the anti-loosening protrusion 232*e* arranged on the engagement end surface 232*d*, and the anti-loosening recess 132*b* arranged on the inclined engagement surface 132*a*. In this way, the anti-loosening effect of the connecting buckle is better, user experience is enhanced, and the connecting buckle is caused to have a long service life through the limiting end surface perpendicular to the central axis of the spring 233.

It should be understood that a person of ordinary skill in the art may make improvements or transformations according to the above description, and all of the improvements and transformations shall fall within the protection scope of the attached claims of the present application.

What is claimed is:

1. A pluggable connecting buckle, comprising a male buckle and a female buckle, wherein a first connecting rod is arranged on one end of the male buckle, a decorative plate and a buckling rib protruding from an inner side of the decorative plate are arranged on an other end of the male buckle, a buckling block is arranged on an end of the buckling rib away from the first connecting rod, and a corresponding engagement groove is arranged on each of two sides of the buckling rib; and a second connecting rod is arranged on one end of the female buckle, an accommodating cavity with an outer open end is arranged on an other end of the female buckle, a blocking block engaged with the buckling block is arranged on an inner end of the accommodating cavity, two corresponding engagement assemblies are respectively arranged on two sides of the accommodating cavity, a limiting plate is arranged on an outer side of each of the engagement assemblies, each engagement assembly comprises a riveting shaft perpendicular to a buckling direction, a turning plate rotatably connected to the riveting shaft, and a spring arranged on the turning plate, one end of the turning plate protruding from the limiting plate is a turning end, an other end of the turning plate configured to abut against the engagement groove is an engagement end, an inclined engagement surface that does not hinder rotation of the engagement end is arranged on a side of the engagement groove close to the buckling block, the spring is arranged on the engagement end, a spring limiting block corresponding to the spring is arranged on the inner end of the accommodating cavity, a notch engaged with the turning end is arranged on the limiting plate, and an inverted hook plane corresponding to the limiting plate is arranged on the turning end.

2. The pluggable connecting buckle according to claim 1, wherein a planar engagement end surface is arranged on an end of the engagement end, and the inclined engagement surface is tangent to a movement trajectory of the engagement end surface when the male buckle and the female buckle are in a buckled state.

3. The pluggable connecting buckle according to claim 2, wherein an anti-loosening protrusion is arranged on the engagement end surface, and an anti-loosening recess corresponding to the anti-loosening protrusion is arranged on the inclined engagement surface.

4. The pluggable connecting buckle according to claim 1, wherein a limiting end surface of the spring limiting block is perpendicular to a central axis of the spring when the male buckle and the female buckle are in a buckled state.

5. The pluggable connecting buckle according to claim 1, wherein the turning end is semicircular, and anti-slip grooves are uniformly arranged on the turning end.

6. The pluggable connecting buckle according to claim 1, wherein a protrusion corresponding to the turning plate is arranged at the notch.

7. The pluggable connecting buckle according to claim 1, wherein a spring fixing base is arranged on a side of the engagement end, and a spring engagement post is arranged on a side of the spring fixing base.

8. The pluggable connecting buckle according to claim 1, wherein a fastening groove is arranged between the buckling rib and the decorative plate, and a planar fastening plate engaged with the fastening groove is arranged on a side of the accommodating cavity close to the decorative plate.

9. The pluggable connecting buckle according to claim 8, wherein a fastening rib parallel to the buckling direction is arranged on an outer side of the planar fastening plate.

10. The pluggable connecting buckle according to claim 1, wherein an end of the male buckle is in the shape of a square frame, a chute is recessed on each of two corresponding inner side surfaces of the square frame, and two ends of the first connecting rod are engaged with the chutes.

* * * * *